United States Patent [19]

Beale

[11] 4,404,802

[45] Sep. 20, 1983

[54] CENTER-PORTING AND BEARING SYSTEM FOR FREE-PISTON STIRLING ENGINES

[75] Inventor: William T. Beale, Athens, Ohio

[73] Assignee: Sunpower, Inc., Athens, Ohio

[21] Appl. No.: 302,102

[22] Filed: Sep. 14, 1981

[51] Int. Cl.[3] ..... F02G 1/04

[52] U.S. Cl. ..... 60/520; 60/517

[58] Field of Search ..... 60/517, 520, 521; 62/6

[56] References Cited

U.S. PATENT DOCUMENTS

| | | | |
|---|---|---|---|
| Re. 30,176 | 12/1979 | Beale | 60/520 |
| 4,183,214 | 2/1980 | Beale et al. | 60/520 |
| 4,188,791 | 2/1980 | Mulder | 60/520 |
| 4,353,683 | 10/1982 | Clark | 60/517 X |

*Primary Examiner*—Allen M. Ostrager

*Assistant Examiner*—Stephen F. Husar

*Attorney, Agent, or Firm*—Frank H. Foster

[57] ABSTRACT

The displacer and piston of a Stirling engine are provided with inner cylindrical walls which serve as bearing surfaces in close fitting, sliding engagement with the outer bearing surface of a longitudinally extending, tubular center post. The internal bore of the center post is in fluid communication with the bounce space. Center porting is provided by passages in the piston, displacer and tubular wall of the center post so that fluid communication is provided periodically between the work space and bounce space and between the displacer gas spring and the bounce space. In this manner, the piston and displacer remain properly positioned within the engine housing.

9 Claims, 3 Drawing Figures

CENTER-PORTING AND BEARING SYSTEM FOR FREE-PISTON STIRLING ENGINES

BACKGROUND OF THE INVENTION

The present invention relates to a free-piston Stirling engines provided with piston and displacer positioning devices and more particularly to those Stirling engines provided with center porting devices, gas springs and spin lubrication.

As the piston and displacer of a free-piston Stirling engine receprocates, there tends to be a nonuniform leakage of gas from one space to another which, if uncontrolled, causes an average pressure increase in the space into which the gas leaks, thereby pushing the piston or displacer one way or another within the engine housing. This occurs between the flow of gas through an annular gap between a cylindrical wall and a moving cylindrical surface is not sinusoidal: it is greater at high pressure than at low pressure. Gas will leak out of a space having a higher pressure peak into a space having a lower pressure peak, and more gas will leak out during the high pressure differential than will leak in during the low pressure differential.

Center porting provides a corrective flow of gas when the displacer or piston is at the center position. In this manner excessively low and excessively high pressure differentials in a particular space may be avoided by providing venting to relieve excessively high pressures and an influx of gas to raise excessively low pressures.

In the past, proper positioning of reciprocating elements has been maintained by providing valves or passageways in the engine housing wall or by providing periodic fluid engagement between a space undergoing substantial pressure variation and a reference space in which the gas pressure is maintained at or about the average pressure of the system.

U.S. Pat. No. 3,899,888 issued Aug. 19, 1975 to Shuman discloses a piston positioning means comprising vertical grooves formed in the center portion of the cylinder wall within which the piston reciprocates. The grooves act as by-pass passageways having a fluid flow impedance that is substantially the same in both directions. As the piston reciprocates, leakage of gas through the grooves tends to maintain the center of piston oscillation near the center of the grooves. A major drawback of this arrangement is that a close tolerance fit must be provided between the cylinder and piston walls so that fluid communication with the grooves is established at the proper piston position. A close fit requires expensive machining or honing of the inner surface of the engine wall. In the present invention, in contrast, a sloppy fit may be provided between the piston and housing and inexpensive piston rings provided therebetween because the primary bearing surfaces are provided by the outer surface of a center rod and the inner cylindrical walls of the piston and displacer. Since the openings in the reciprocating elements are substantially smaller in diameter than the engine housing, it is less expensive to provide a close tolerance fit between center rod and inner piston wall in the present invention than between the outer piston wall and engine housing in the Shuman patent.

U.S. Pat. No. 4,183,214 issued Jan. 15, 1980 to Beale et al. discloses a displacer provided with a cylindrical bore and a gas spring compartment formed therein. A rod is fixed to the engine housing at one end by means of a spider. The other end is slideable in the cylindrical bore provided in the displacer. Center porting passages are provided in the displacer and the stationary rod so that the central position of the displacer can be maintained. A major drawback with this arrangement is that the spider is an impediment to the movement of the piston and displacer. These reciprocating elements tend to come together at a certain point in the Stirling cycle. Since the spider maintains a fixed position between piston and displacer, it is impossible to have an overlap of the piston and displacer strokes, thus lowering power and efficiency. In the present invention, a stationary center rod is fixed to the housing at a point which does not interfere with the movement of the reciprocating elements. In addition, the present center rod arrangement permits the piston and displacer to rotate in order to provide for spin lubrication. In the earlier Beale et al. patent, however, the spider would interfer with and eventually be mangled to a spinning piston or displacer.

SUMMARY AND OBJECTS OF THE INVENTION

The present center-porting and bearing system for free-piston Stirling engines comprises a stationary center rod extending along the axis of reciprocation of the power piston and displacer. The center rod is provided with an outer bearing surface which is in close-fitting, sliding engagement with axially extending, inner cylindrical walls formed in the piston and displacer. Preferably, the center rod also includes a central cavity in fluid communication with a gas containing reference space formed in the engine housing, and first and second passageways respectively provide fluid communication between the central cavity and the outer bearing surface of the rod at the desired midpoints of oscillation of the reciprocating piston and displacer. The piston, in turn, may be provided with a channel or bore extending from its inner cylindrical wall to a gas-containing work space, and the displacer may be provided with a gas-containing compartment and a channel or bore extending from the inner cylindrical wall to that compartment. In this manner, periodic fluid communication is provided between the central cavity of the center rod and the work space as well as between the central cavity and the displacer compartment, as the piston and displacer pass through their desired midpoints of oscillation.

One of the primary objects of the present invention is to provide a less expensively fabricated Stirling engine by requiring only the center rod and the inner walls of the piston and displacer to be closely fit and allowing loose fits and piston rings between the outer walls of the piston and displacer and the engine housing.

Another object of the present invention is to provide an efficient means of center-porting both piston and displacer.

A further object of the present invention is to allow the piston and displacer to spin for hydrodynamic lubrication.

Still another object of the present invention is to allow an overlap in the piston and displacer strokes for higher power and efficiency.

Other advantages of the present invention are more readily apparent with reference to the following description and drawings.

BRIEF DESCRIPTION OF THE DRAWINGS

FIG. 3 is a view in section of a preferred embodiment of the invention.

DETAILED DESCRIPTION OF THE PREFERRED EMBODIMENT

Figure 1:
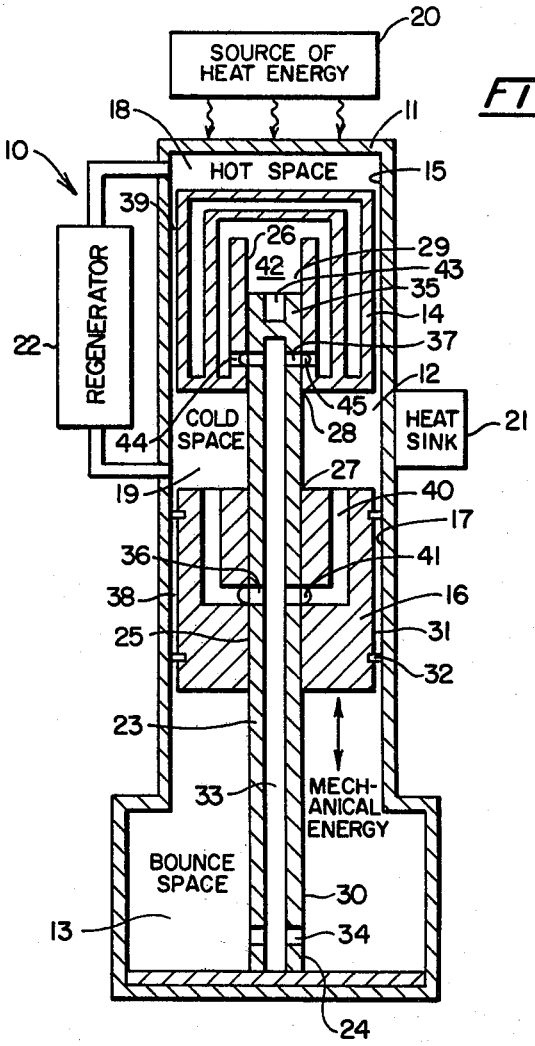
FIG. 1 is a diagrammatic view of a free-piston Stirling engine embodying the center-porting and bearing system of the present invention and of the type in which the displacer and power piston are axially aligned.
Figure 2:
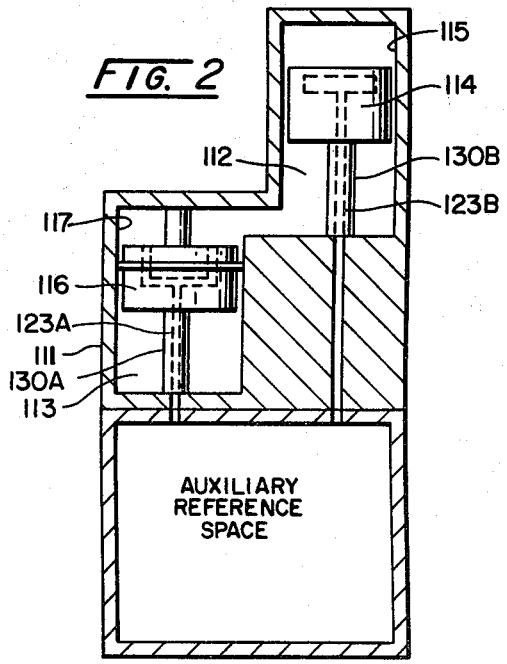
FIG. 2 is a diagrammatic view illustrating an alternative embodiment of the invention similar to FIG. 1 but in which the displacer and power piston are not axially aligned.

FIG. 1 illustrates a free-piston Stirling engine, generally designated 10, provided with a housing 11 which defines a work space 12 and a bounce or reference space 13. The work space and bounce space contain a gas such as air, hydrogen, helium or the like. A displacer piston 14 is reciprocally slideable in a displacer cylinder 15 formed by a portion of the interior wall of the housing 11 or as otherwise provided in the work space 12. A power piston 16 is reciprocally mounted in a power piston cylinder 17 formed by another, and preferably overlapping, portion of the interior wall of the housing 11 or as otherwise provided so as to be in fluid communication with the work space 12. Preferably, the displacer 14 and power piston 16 are axially aligned, as illustrated in FIG. 1, although it is entirely possible for them to be nonaligned, as illustrated in FIG. 2, so long as the power piston remains in fluid communication with the work space 12.

The work space 12 may be subdivided further into a hot space 18 and a cold space 19. The structures in FIGS. 1 and 2 are operated as engines or motors by the application of heat from a heat source 20 to the associated hot space 18 and the removal of heat from the cold space 19 by means of a heat exchanger or heat sink 21. A regenerator 22 may be provided in the usual manner for enhancing the transfer of thermal energy. As is well known in the art, devices of the type generally described above may be used to drive linear alternators or pumps and may also be operated as refrigeration and heating devices or for other heat pump applications by applying a reciprocating mechanical energy to the power piston 16. It should therefore be understood that the structures of the present invention may be used advantageously in all of these modes of operating a Stirling cycle device.

As illustrated in FIG. 1, an elongated center rod 23 is fixed at one end 24 within the housing 11 and extends along the axis of reciprocation of the displacer 14 and power piston 16. The power piston and displacer are each provided with inner cylindrical walls 25 and 26 respectively. The inner cylindrical piston wall 25 extends axially through the power piston, thereby defining a central bore 27 therein. The inner cylindrical displacer wall 26, on the other hand, extends from one end 28 of the displacer into a central portion of the displacer, thereby defining a central opening 29 in said displacer.

The center rod 23 is provied with an outer bearing surface 30 upon which the inner cylindrical piston wall 25 and the inner cylindrical displacer wall 26 are slidingly engaged. Both the outer bearing surface 30 and the inner cylindrical walls of the displacer and piston are machined to provide a close fit therebetween as the displacer and piston engage in reciprocal motion relative to the stationary center rod 23. Preferably, the power piston 16 and displacer 14 also engage in rotational movement as they reciprocate, thereby providing hydrodynamic or spin lubrication between their inner cylindrical walls 25 and 26, respectively and the outer bearing surface 30 of the center rod.

The present close fitting arrangement provided between the center rod and the inner cylindrical wall of the piston obviate the need for providing a close tolerance fit between the outer wall 31 of the power piston and the surrounding wall of the power piston cylinder 17. Instead, a sloppy fit may be employed advantageously therebetween and one or more piston rings 32 provided to limit the leakage of gas between the bounce space 13 and work space 12 as the piston oscillates. Piston rings are not necessary between the displacer and displacer cylinder 15 because the regeneration system requires a flow of gas between the hot space 18 and cold space 19 as the displacer reciprocates, as is well known in the art.

The close tolerance fit between the outer bearing surface 30 of the center rod and the displacer and piston inner cylindrical walls 25 and 26 may be employed advantageously to provide a center-porting, as well as the above described bearing system for the displacer and piston or a free-piston Stirling engine. For this purpose the center rod is preferably provided with an axially extending center cavity 33 which is in fluid communication with the reference or bounce space 13 by means of one or more ports 34. In this manner, gas contained in the reference space also circulates in the central cavity 33. The central cavity is closed at the free end 35, opposite the fixed end 24 of the center rod.

It is useful to the proper functioning of this preferred form of the invention that the reference space 13 encompass such a substantial volume that the pressure variations of the gas contained therein are negligible. Ideally, the gas contained in the bounce space 13 is maintained at an average pressure of the whole system. If the volume of the bounce space were so small as to permit the gas contained therein to undergo substantial variations in pressure as the power piston oscillated, it would be advisable to provide fluid communication between an auxiliary gas containing reference space (FIG. 2) and the central cavity 33 of the center rod, rather than using the bounce space as a reference volume.

Fluid communication between the central cavity 33 of the center rod and its outer bearing surface 30 is provided by first and second passageways 36 and 37, respectively. The first passageway 36 is located on the outer bearing surface substantially at the desired midpoint of oscillation, indicated at 38 of the power piston 16. The second center rod passageway 37 is located on the outer bearing surface substantially at the desired midpoint of oscillation indicated at 39 of the displacer 14.

The power piston 16 in turn is preferably provided with a channel or bore 40 extending from the inner cylindrical piston wall 25 to the work space 12. The channel 40 has an opening 41 on the inner piston wall which comes into registry with the first center rod passageway 36 as the power piston passes through its desired midpoint of oscillation. In this manner, periodic fluid communication may be provided between the work space 12 and the reference space 13 via the central cavity 33 of the center rod. Preferably, the opening 41 is formed as an annular groove on the inner piston wall 25 so that proper registration between the channel 40 and first passageway 36 may be established as the piston rotates.

A gas-containing compartment or gas spring 42 may be formed in the central portion of the displacer 14 adjacent to the central opening 29 defined by the inner cylindrical displacer wall 26. As the displacer reciprocates relative to the free end 35 of the center rod, the gas contained in the compartment 42 is alternately compressed and expanded. As illustrated in FIG. 1, the free end 35 may also be provided with a cavity 43 which communicates with the displacer compartment 42 and which serves as an additional space within which the gas spring operates.

In a manner somewhat analogous to the power piston, the displacer may be provided with a channel 44 extending from the inner cylindrical displacer wall 26 to the gas spring compartment 42. The channel 44 has an opening 45 on the inner displacer wall which comes into registry with the second center rod passageway 37 as the displacer passes through its desired midpoint of oscillation. In this manner, periodic fluid communication may be provided between the gas spring compartment 42 and the reference space 13 via the central cavity of the center rod. Preferably, the opening 45 is formed as an annular groove on the inner displacer wall 26 so that proper registration between the channel 44 and second passageway 37 may be established as the piston rotates.

FIG. 2 illustrates a free-piston Stirling engine provided with a displacer 114 and a power piston 116 which are not axially aligned. In accordance with the present invention, however, the power piston is provided with a first center rod 123*a*, and the displacer is provided with a second center rod 123*b*. Like the center rod illustrated in FIG. 1, the first and second alternative center rods illustrated in FIG. 2 are fixed at one of their respective ends to the housing 111 and are provided with outer bearing surfaces 130*a* and 130*b*, respectively. As can be seen, the center-porting and bearing system for the non-axially aligned displacer and piston employ substantially the same components and operate in substantially the same manner as the axially aligned displacer and piston illustrated in FIG. 1.

The preferred embodiment of FIG. 3 has a housing 210 containing a displacer 212 and power piston 214 connected to the reciprocating portion 216 of a linear alternator. The power piston 214 is provided with passages 218 which communicate between the working space 220 and the interior of the center post 222. The interior of the center post 222 also communicates with the bounce space 224 through the post 226.

THEORY AND METHOD OF OPERATION

The gas contained in the bounce or reference space is at an average pressure of the whole system. As a general rule, any gas-containing space in a free-piston Stirling engine having a significant swing in pressure should be communicated to the reference space at the desired center position of the device, such as the power piston or displacer, that is causing the pressure change. The need for this periodic fluid communication is a result of the need to offset nonuniform leakage of gas from one space to another. This nonuniform leakage, if not counteracted, causes an average pressure increase which pushes the power piston or displacer one way or the other. This effect, in turn, is the result of the nonlinearity of the flow of gas through an annular gap, as described in the background of the invention. Gas always wants to leak out of whichever spaced has the higher pressure peak under assymetrical pressure variations.

By providing the displacer with a gas spring, the dynamics of the displacer operation are aided in a manner well known in the art. As the displacer cycles back and forth around its mid point, the gas in the gas spring is periodically in communication with the bounce space in the position where the displacer channel and second passageway of the center rod are in registration. The bounce space is sufficiently large so that the pressure of the gas contained therein remains substantially constant. The bounce space gas therefore acts upon the gas spring in such a manner that the gas spring pressure is maintained within a range that keeps the displacer in proper position within the work space. As the displacer reciprocates, the gas pressure in the gas spring compartment is periodically engaged with the bounce space gas pressure. Thus, the displacer continues to oscillate in the same limited space.

In a somewhat similar manner, the work space is periodically in fluid communication with the central cavity of the center rod and, consequently, with the bounce space via the piston channel which periodically comes into registry with the first passageway in the center rod. Like the displacer gas spring, the work space is in fluid communication with bounce space at the desired midpoint of osciallation of the proper piston.

The center-porting effect described above takes on additional significance when the power piston is provided with a piston ring to slidingly engage the housing. Use of a piston ring to minimize leakage of gas around the outer surface of the power piston is very desirable because it permits an inexpensive, sloppy fit to be employed between the housing and outer surface of the piston. The piston ring, however, is grossly unpredicable from one cycle to the next as to which way it will leak gas. Thus absent the present center-porting system, the piston would one minute be too far in and the next minute too far out.

Moreover, the center rod is necessary if piston rings are to be used because otherwise, if the housing, as opposed to the center rod, were to be center-ported, the sloppy fit between housing and outer piston wall would make it impossible to obtain proper registration at the midpoint of reciprocation of the piston. With a sloppy fit, gas would flow unpredicatably between the bounce space and working space.

Despite the fact that piston rings are erratic in their leak characteristics, they can be used benefically in the present invention because the effect of the center-porting via the close-fitting center rod overcomes the errectic piston ring leak drawbacks.

Another advantages to a sloppy fit at the outer diameter of the piston is that it enhances spin which provides the gas lubrication effect on the close-fitting center rod.

While preferred embodiments of the present invention have been illustrated and described in detail, it will be understood that various modifications in details of construction and design may be made without departing from the spirit of the invention or the scope of the following claims.

I claim:

1. In an improved free-piston Stirling engine provided with a housing which defines a work space and a reference space, a gas contained in said work space and said reference space, a displacer reciprocating in said work space and a reciprocating power piston in fluid communication with said work space, that improvement which comprises:

(a) an inner cylindrical piston wall extending axially through said power piston and defining a central bore in said piston;

(b) an inner cylindrical displacer wall extending from one end of said displacer into a central portion thereof and defining a central opening in said displacer; and (c) an elongated center rod fixed within said housing and providing an outer bearing surface upon which said inner cylindrical piston wall and said inner cylindrical displacer wall are slidingly engaged.

2. An improved free-piston Stirling engine according to claim 1 wherein said center rod is provided with an axially extending central cavity in fluid communication with said reference space, said center rod being further provided with a first passageway providing fluid communication between said central cavity and the outer bearing surface of said rod, and said first passageway being located on said outer bearing surface substantially at the desired midpoint of oscillation of the reciprocating power piston.

3. An improved free-piston Stirling engine according to claim 2 wherein said power piston is provided with a channel extending from the inner piston wall to the work space, said channel having an opening on said inner piston wall which is in registry with the first passageway on the outer bearing surface of the center rod as said piston passes through the desired midpoint of oscillation, thereby providing periodic fluid communication between said work space and the central cavity of said center rod.

4. An improved free-piston Stirling engine according to claim 1 wherein said center rod is provided with an axially extending central cavity in fluid communication with the reference space, said center rod being further provided with a second passageway providing fluid communication between said central cavity and the outer bearing surface of said rod, and said second passageway being located on said outer bearing surface substantially at the desired midpoint of oscillation of the reciprocating displacer.

5. An improved free-piston Stirling cycle engine according to claim 4 wherein the central portion of said displacer defines a gas-containing compartment and wherein said displacer is provided with a channel extending from the inner displacer wall to said gas-containing compartment, said channel having an opening on said inner displacer wall which is in registry with the second passageway on the outer bearing surface of the center rod as said displacer passes through the desired midpoint of oscillation, thereby providing periodic fluid communication between said gas-containing compartment and the central cavity of said center rod.

6. An improved free-piston Stirling engine according to claim 1 wherein the displacer and power piston are not axially aligned and each is provided with a center rod.

7. An improved free-piston Stirling engine according to claim 1 wherein a sloppy fit is provided between the housing and the power piston and between said housing and the displacer and wherein said power piston is provided with one or more piston rings which slidingly engage said housing.

8. An improved free-piston Stirling engine according to claim 1 wherein the power piston and displacer rotate as well as reciprocate.

9. In an improved free-piston Stirling engine provided with a housing which defines a work space and a reference space, a gas contained in said work space and said reference space, a displacer reciprocating in said work space and a reciprocating power piston in fluid communication with said work space, that improvement which comprises:

(a) an inner cylindrical piston wall extending axially through said power piston and defining a central bore in said piston;

(b) an inner cylindrical displacer wall extending from one end of said displacer and defining a central opening in said displacer;

and (c) an elongated center rod fixed within said housing and providing an outer bearing surface upon which said inner cylindrical piston wall and said inner cylindrical displacer wall are slidingly engaged.

* * * * *